United States Patent [19]

Morissette

[11] 4,111,147

[45] Sep. 5, 1978

[54] COLLAPSIBLE BOAT ANCHOR

[76] Inventor: Gilles Morissette, 7950 Jacques Rousseau Ave., Apt. 403, Riviére-des-Prairies, Quebec, Canada, H1E 1J6

[21] Appl. No.: 791,037

[22] Filed: Apr. 26, 1977

[30] Foreign Application Priority Data

Apr. 28, 1976 [GB] United Kingdom ..... 17225/76

[51] Int. Cl.[2] ..... B63B 21/24

[52] U.S. Cl. ..... 114/298; 114/303

[58] Field of Search ..... 114/298, 297, 303, 294, 114/301, 304; 64/28 R; 294/83 A, 83 R; 43/44.96, 44.97

[56] References Cited

U.S. PATENT DOCUMENTS

| | | | |
|---|---|---|---|
| 2,789,526 | 4/1957 | Gollner | 114/298 |
| 2,847,963 | 8/1958 | Knitter | 114/298 |
| 2,851,983 | 9/1958 | Hrivnyak | 114/298 |
| 2,914,015 | 11/1959 | Farr | 114/298 |
| 2,985,132 | 5/1961 | Detrick | 114/298 |
| 3,283,736 | 11/1966 | Williams | 114/298 |
| 3,485,199 | 12/1969 | Schuman | 114/298 |
| 3,656,448 | 4/1972 | Farnsley | 114/298 |
| 3,747,553 | 7/1973 | Riddle, Sr. | 114/298 |
| 4,005,671 | 2/1977 | Ogle | 114/298 |

FOREIGN PATENT DOCUMENTS

| | | | |
|---|---|---|---|
| 680,554 | 10/1952 | United Kingdom | 43/44.96 |

*Primary Examiner*—Robert B. Reeves
*Assistant Examiner*—Edward M. Wacyra

[57] ABSTRACT

A boat anchor which includes a hollow shank having a line attachment eye at one end and protruding fins at the other end. Anchor flukes are pivoted to the fins for movement between three positions, namely: an operative position extending generally laterally away from the shank, an anchor-releasing position in which the anchor flukes extend longitudinally of the shank and away from the line attachment eye, and a storage position in which the anchor flukes extend alongside the shank towards the eye; shear pins carried by the fins are broken by the anchor flukes under the application of a predetermined load to permit pivotal movement of the anchor flukes into their anchor-releasing position. A spring-loaded plunger resiliently maintains the anchor flukes in either one of their storage and operative positions. A stop bolt can be adjusted to block the plunger into a position in which it positively locks the flukes in their operative position, whereby anchor-releasing is no longer possible.

3 Claims, 6 Drawing Figures

COLLAPSIBLE BOAT ANCHOR

FIELD OF THE INVENTION

The present invention relates to boat anchors and, more particularly, to boat anchors having collapsible flukes which operate to release the anchor under a predetermined load.

SUMMARY OF THE INVENTION

The collapsible boat anchor of the present invention has anchor flukes which are pivotable between three positions, namely: a folded position alongside the anchor shank for storage purposes, in order to take up a minimum of room; an operative position extending transversely of the shank; and an anchor-releasing position extending longitudinally of and away from the shank. The anchor flukes are maintained in operative position by means of shear pins which are broken by the anchor flukes under the application of a predetermined pull on the anchor, the shear pins positively preventing the anchor from tripping open unless there is applied a tensional force much in excess of the normal tension exerted by an anchored boat on the anchor. The flukes are resiliently maintained in either one of their storage and operative positions under the action of a spring-loaded plunger. Means are provided to releasably lock the plunger in a position such as to positively maintain the flukes in operative position, so that the shear pins can no longer be operative.

Preferably, the location of the shear pins can be adjusted to adjust the load under which the anchor flukes will trip into anchor-releasing position.

DESCRIPTION OF THE DRAWINGS

In the drawings, like reference characters indicate like elements throughout.

DESCRIPTION OF THE PREFERRED EMBODIMENTS

Figure 1:
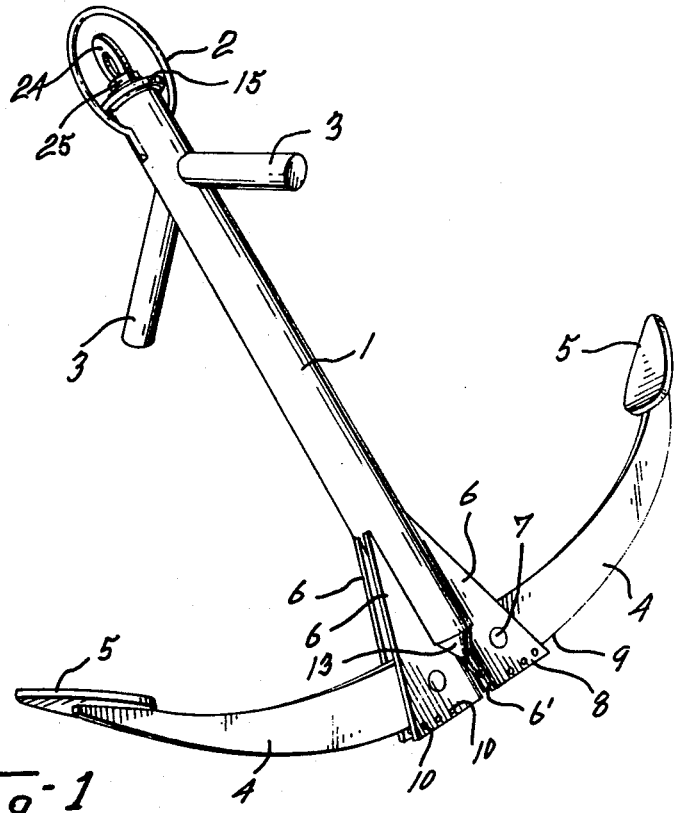
FIG. 1 is a perspective view of a two-fluke anchor in accordance with the invention.

FIG. 1 shows a first embodiment of the anchor of the invention, which includes an elongated tubular shank 1, to one end of which is fixed a line attachment eye member 2, in the form of a wire yoke welded to the end of the shank. Adjacent the same end of the shank, rod-like downwardly inclined arms 3 are rigidly secured to the shank. The other end of the shank carries anchor flukes 4. These anchor flukes are preferably made of flat stock with a certain curvature carrying at their outer ends triangular plates 5 disposed transverse to the flat stock flukes. Each fluke is pivotally mounted at the other end of the shank 1. For this purpose, a pair of flat, parallel fins 6, one pair for each anchor fluke, is welded or otherwise secured to the lower end portion of the shank 1.

Figure 4:
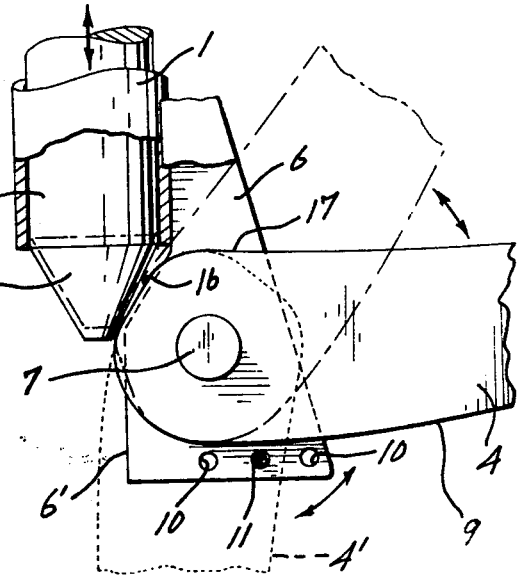
FIG. 4, seen on the first page of the drawings, is a partial elevation, partially cut away, of the lower end of the shank and of the plunger and of the pivoted end of one anchor fluke.

The inner end of each anchor fluke 4 is inserted between a pair of fins 6 and is pivoted thereto by means of a transverse pivot pin 7. The fins 6 are generally triangular in shape with their base defining a straight lower edge 8 protruding downwardly from the lower edge 9 of the flukes 4 in the operative position of the flukes, as shown in FIG. 1, that is in their position in which the flukes extend generally laterally transversely of the shank 1. The lower edge portions of the fins 6 are provided with a series of registering holes 10. Each pair of registering holes can receive a shear pin 11, as shown in FIG. 4. When the anchor flukes are in their operative position, the shear pin 11 is disposed across and adjacent the lower edge 9 of the anchor flukes and is therefore in the path of the anchor flukes when the same tend to move to its anchor-releasing position, shown in dotted lines at 4'. Thus, the shear pin 11 has to be broken to release the anchor when the latter is fouled. In the anchor-releasing position, each fluke extends longitudinally of the shank in a direction away from the eye member 2. The shear pin will be broken when a pull in excess of the pull exerted on the anchor by an anchored boat, is exerted on the anchor line.

It will be noted that the three pairs of holes 10 are disposed at progressively increasing radial distances from the pivot pin 7, so that one can adjust the shear pin breakage force, using the same resistance shear pin. Obviously, also, shear pins of various resistances to breakage can be used.

Easily available ordinary nails can be used as shear pins, as these provide the desired resistance to breakage.

The lower end of the shank 1 is open and a cylindrical plunger 12 is mounted for slidable movement within the hollow shank; said plunger has a tapered lower end 13 exposed at the lower end of the shank 1. The plunger is spring-biased away from the eye member 2 by means of a compressible coil spring 14 located within the shank and bearing against the top end of the plunger 12 at one end and against a closure cap 15 removably secured to the upper end of shank 1, as shown in FIG. 2.

Figure 2:
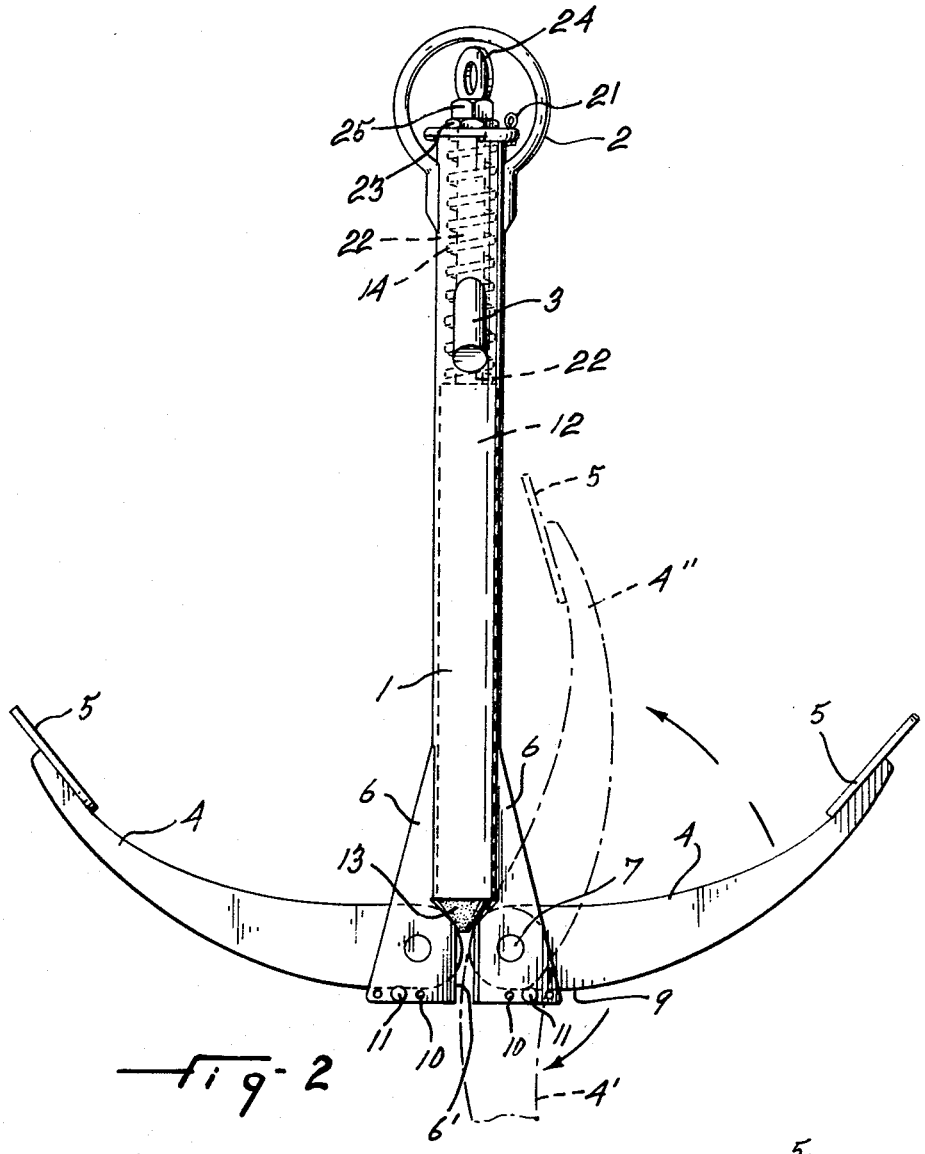
FIG. 2 is an elevation of the anchor showing the three possible positions of the anchor flukes.
Figure 3:
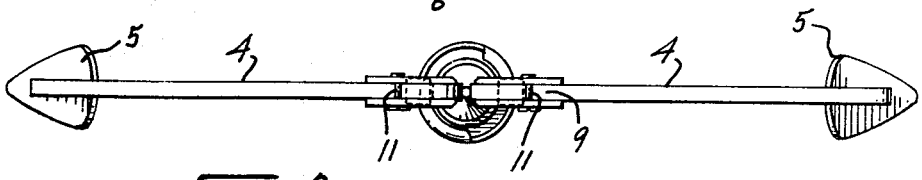
FIG. 3 is a bottom plan view of the anchor of FIG. 2.
Figure 5:
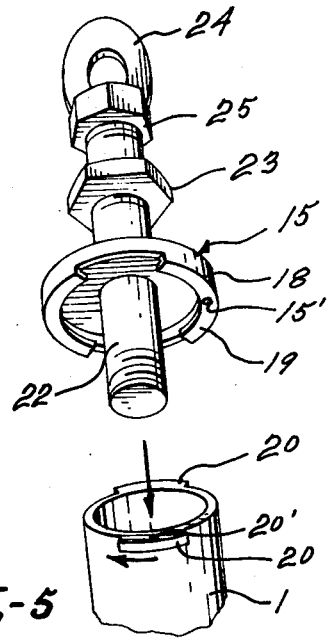
FIG. 5 is an exploded perspective view of the top portion of the anchor shank.

The inner end of each anchor fluke 4 is provided with a flat 16 on an otherwise rounded edge, said flat being engaged by the tapered end 13 of the plunger when the flukes 4 are in their operative position, as clearly shown in FIGS. 2 and 4. Thus, the anchor flukes are resiliently maintained against accidental movement from their operative position to their storage in which they extend alongside the shank 1 towards the eye member 2, as shown at 4'' in FIG. 2.

In this latter storage position, the tapered surface 13 of the plunger engages a second flat, namely: the flat top edge portion 17 of the anchor fluke. Thus, the anchor flukes are also resiliently maintained by the plunger in their storage position and cannot accidentally take an operative position.

It will be noted that pivot pins 7 are located outwardly of shank 1 to allow the anchor flukes 4 to take their storage position 4''.

In any pivoted position of the anchor flukes 4, the inner rounded end edge of the latter and edges 6' of fins 6 are in the path of the plunger 12 and prevent sliding of the latter off the lower end of shank 1.

The cap 15 has a skirt 18 provided spaced inwardly directed flanges 19 forming an interrupted screw thread engageable with spaced outwardly directed flanges 20 secured to the upper end of the shank 1.

The flanges 19, 20 can be inter-digitated and are complementary so that upon rotation of the cap, the flanges 19 come in underlying overlapping relation with the shank flanges 20 to firmly secure the cap to the shank. The cap can be removed by a simple one-quarter rotation of the cap to gain access to spring 14 and plunger 12. The cap is locked in closed position by a cutter pin 21, as shown in FIG. 2, extending through aligned holes 15' made through the cap, its flange 19 and extending through a hole 20' of shank flange 20.

Means are also provided to positively lock the anchor flukes 4 in operative position, whenever desired. For this purpose, a bolt 22 is screwed within the center of cap 15 and can be longitudinally adjusted to firmly abut against the top end of the plunger 12 with the latter in engagement with the flats 16 of the anchor flukes 4 in the operative position of the latter. Thus, the plunger is positively prevented from any longitudinal movement and the flukes are locked in operative position. Unscrewing of the bolt 22 will permit longitudinal movement of the plunger against the action of the spring 14, allowing folding movement of the flukes to either one of its storage or anchor-releasing positions. The bolt 22 can be rotated by hand and then locked in adjusted position by a lock nut 23. It can also be rotated by a suitable tool inserted through an eye 24 fixed to the upper end of the bolt 22, or by means of a key engaging a nut 25 integral with the eye 24.

Figure 6:
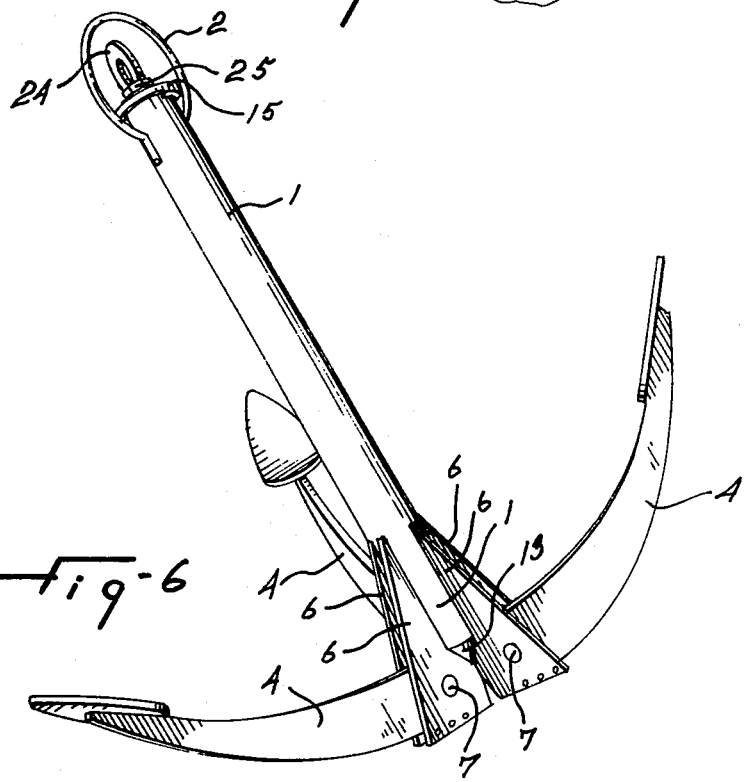
FIG. 6 is a perspective view of a three-fluke anchor, also made in accordance with the principles of the invention.

FIG. 6 shows a boat anchor in accordance with the invention provided with three anchor flukes 4 instead of two, as in the previous embodiment. The three anchor flukes are equally angularly spaced apart and are each pivotally mounted by means of a pivot pin 7 to a pair of parallel fins 6. There are being three pairs of such fins: one pair for each anchor fluke. The anchor is otherwise identical to the first embodiment with the tapered end 13 of the plunger 12 engaging the three flats of the three anchor flukes in the operative positions of the latter.

I claim:

1. A collapsible boat anchor comprising an elongated tubular shank member open at both ends, a line attachment means at one end, pairs of parallel fins secured to the other end of said shank member and laterally extending therefrom, anchor flukes each having an inner end inserted between one of said pairs of fins and pivotally connected thereto about respective pivot pins for movement of said anchor flukes between three positions, namely: a storage position in which the anchor flukes extend alongside the shank towards said one end, an operative position extending generally laterally away from the shank, and an anchor-releasing position in which the anchor flukes extend longitudinally of, and away from, said one end, said fins protruding from an edge of the respective anchor flukes in the operative position of the latter and provided with a pair of registering holes adapted to receive a shear pin, a shear pin inserted in said registering holes, the shear pins of the associated anchor flukes being in the path of the latter to prevent said anchor flukes from pivoting from said operative to said anchor-releasing position, whereby said last-named pivoting movement is accomplished only upon braking of said shear pins by said flukes, a plunger mounted within said tubular shank and protruding from the other open end of said shank, a removable cap for closing said one end of said tubular shank, means to removably secure said cap to said one end, a spring disposed within said tubular shank and abutting against said cap at one end and against said plunger at the other end, said spring compressible by movement of said plunger towards said one end, said anchor flukes having flats at their pivoted end which are engaged by said plunger in the operative and storage positions, respectively, of said anchor flukes, whereby said anchor flukes can be pivoted between said operative and said storage position by displacing said plunger against the bias of said spring, and further including a bolt screwed within said cap extending through said spring and adapted to abut against said plunger, said bolt in an adjusted position thereof relative to said cap, preventing longitudinal movement of said plunger and maintaining the same against said flats in the operative position of said anchor flukes.

2. A collapsible boat anchor as claimed in claim 1, wherein there are several pairs of registering holes disposed at progressively increasing radial distances from said pivot pin, each pair of holes adapted to receive a shear pin.

3. A collapsible boat anchor as claimed in claim 1, wherein the outer end of said plunger is conically shaped and is adapted to engage the flats of the respective anchor flukes.

* * * * *